US008928441B2

(12) United States Patent
Prabhakaran et al.

(10) Patent No.: US 8,928,441 B2
(45) Date of Patent: Jan. 6, 2015

(54) LIQUID COOLED MAGNETIC COMPONENT WITH INDIRECT COOLING FOR HIGH FREQUENCY AND HIGH POWER APPLICATIONS

(75) Inventors: Satish Prabhakaran, Albany, NY (US); Konrad Roman Weeber, Rexford, NY (US); Richard S. Zhang, Rexford, NY (US); Charles Michael Stephens, Pattersonville, NY (US); Mark Edward Dame, Niskayuna, NY (US); Yang Cao, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/275,544

(22) Filed: Oct. 18, 2011

(65) Prior Publication Data

US 2012/0092108 A1 Apr. 19, 2012

(30) Foreign Application Priority Data

Oct. 19, 2010 (CN) ..... 2010 1 0516326

(51) Int. Cl.

| | |
|---|---|
| ***H01F 27/08*** | (2006.01) |
| ***H01F 27/10*** | (2006.01) |
| ***H05B 6/10*** | (2006.01) |
| ***H01F 27/28*** | (2006.01) |
| ***H01F 27/32*** | (2006.01) |

(52) U.S. Cl.

CPC ..... *H01F 27/2876* (2013.01); *H01F 27/10* (2013.01); *H01F 27/32* (2013.01)

USPC ..... 336/55; 336/57; 336/62; 219/632

(58) Field of Classification Search

CPC ..... H01F 27/2876; H01F 6/04; H01F 27/10; H01F 30/12; H01F 41/047; H05H 1/46; H02J 5/005; H04B 5/0037; H04B 5/0075; H05B 6/02

USPC ..... 336/55, 57, 62, 195; 219/632, 635; 310/64, 180, 201

See application file for complete search history.

(56) References Cited

U.S. PATENT DOCUMENTS

| | | | | |
|---|---|---|---|---|
| 1,986,353 | A * | 1/1935 | Northrup | 219/660 |
| 2,419,116 | A * | 4/1947 | Cassen et al. | 219/645 |

(Continued)

FOREIGN PATENT DOCUMENTS

| | | |
|---|---|---|
| DE | 2854520 A1 | 6/1980 |
| EP | 0364811 A2 | 4/1990 |

(Continued)

OTHER PUBLICATIONS

Kjellqvist, "Design Considerations for a Medium Frequency Transformer in a Line Side Power Conversion System", 35th Annual Power Electronics Specialists Conference, vol. 1, pp. 704-710, Jun. 20-25, 2004.

(Continued)

*Primary Examiner* — Alexander Talpalatski
*Assistant Examiner* — Joselito Baisa
(74) *Attorney, Agent, or Firm* — GE Global Patent Operation; Catherine J. Toppin

(57) ABSTRACT

A magnetic component such as a transformer or inductor comprises one or more litz-wire windings and one or more metallic cooling tube windings. Each litz-wire winding is wound together with a corresponding single metallic cooling tube winding on a common bobbin to provide an indirectly-cooled magnetic component.

17 Claims, 5 Drawing Sheets

(56) References Cited

U.S. PATENT DOCUMENTS

| | | | | |
|---|---|---|---|---|
| 3,046,320 | A * | 7/1962 | Gassen | 373/141 |
| 3,246,271 | A | 4/1966 | Ford | |
| 3,619,479 | A * | 11/1971 | Bogner | 174/125.1 |
| 4,001,746 | A * | 1/1977 | Tjernstrom et al. | 336/62 |
| 4,317,979 | A | 3/1982 | Frank et al. | |
| 4,430,591 | A * | 2/1984 | Nemeni et al. | 310/71 |
| 4,485,289 | A * | 11/1984 | Schwartz | 219/90 |
| 4,532,398 | A * | 7/1985 | Henriksson | 219/674 |
| 4,663,604 | A * | 5/1987 | VanSchaick et al. | 336/96 |
| 4,874,916 | A * | 10/1989 | Burke | 219/671 |
| 5,101,086 | A * | 3/1992 | Dion et al. | 219/632 |
| 5,313,176 | A * | 5/1994 | Upadhyay | 333/181 |
| 5,461,215 | A * | 10/1995 | Haldeman | 219/677 |
| 5,545,966 | A * | 8/1996 | Ramos et al. | 320/108 |
| 5,594,315 | A * | 1/1997 | Ramos et al. | 320/108 |
| 5,973,423 | A * | 10/1999 | Hazelton et al. | 310/12.02 |
| 6,900,420 | B2 * | 5/2005 | Markegård et al. | 219/632 |
| 7,041,944 | B2 * | 5/2006 | Pilavdzic et al. | 219/601 |
| 7,045,704 | B2 | 5/2006 | Areskoug | |
| 7,274,281 | B2 * | 9/2007 | Sugioka | 336/170 |
| 7,973,628 | B1 | 7/2011 | MacLennan | |
| 8,162,640 | B2 * | 4/2012 | Chen et al. | 425/3 |
| 2004/0239463 | A1 | 12/2004 | Poniatowski et al. | |
| 2008/0122566 | A1 | 5/2008 | Tegart | |
| 2009/0302986 | A1 * | 12/2009 | Bedea | 336/55 |
| 2010/0090557 | A1 * | 4/2010 | El-Refaie et al. | 310/198 |

FOREIGN PATENT DOCUMENTS

| | | | |
|---|---|---|---|
| EP | 1176615 | A2 | 1/2002 |
| EP | 1715495 | A2 | 10/2006 |
| EP | 2034494 | A2 | 3/2009 |
| WO | 9834250 | A1 | 8/1998 |
| WO | 02052900 | A1 | 7/2002 |

OTHER PUBLICATIONS

Search Report and Written Opinion from corresponding EP Application No. 11185327.1-2208 dated Jan. 31, 2012.

EP Search Report and Opinion dated Oct. 8, 2012 from corresponding EP Application No. 11185327.1.

* cited by examiner

LIQUID COOLED MAGNETIC COMPONENT WITH INDIRECT COOLING FOR HIGH FREQUENCY AND HIGH POWER APPLICATIONS

BACKGROUND OF THE INVENTION

1. Field of the Invention

Embodiments of the subject matter disclosed herein generally relate to magnetic components, and more particularly, to a multiple mega-Watts (MW) level dry type power transformer operating at voltage levels in the kV range and capable of operating at a fundamental frequency ranging from about hundreds of Hz up to about 1 kHz in a power converter.

2. Description of the Prior Art

Most commercial solutions presently implement dry-type transformers which are either air-cooled or which implement direct cooling for windings (such as hollow metallic tubes that conduct both a cooling fluid and electrical current in the tube). Air-cooled transformers at this power level and frequency approach sizes that are undesirably large. Direct-liquid-cooled tubes exhibit poor packing factors and result in large windows for the winding(s). Further, directly cooled windings exhibit high losses since they cannot be transposed and stranded like litz-wire.

The liquid cooling system of the transformer preferably shares the cooling liquid with the cooling circuit of a power converter. The cooling fluid(s) in modern power electronics is typically in direct contact with several parts of the system. It is known that de-ionized (DI) water interacts with aluminum heat sinks of the converter that are used for cooling semiconductors. The use of copper for cooling tubes of the transformer in such a system should desirably be avoided in the thermal path to eliminate electrochemical interaction that leads to corrosion of the aluminum heat sinks, thus ruling out any direct cooling solution via hollow copper tubes for the transformer. Directly cooled transformer solutions using indirect cooling allows use of Litz wire resulting in a much lower coil loss.

In view of the foregoing, there is a need for a multiple MWs level dry type power transformer capable of operating at a fundamental frequency ranging from about hundreds of Hz up to about 1 kHz in a power converter. The power transformer should avoid the foregoing electrochemical effects, provide a superior packing factor when compared to a hollow aluminum design, and should have a substantially higher efficiency than known solutions.

BRIEF DESCRIPTION OF THE INVENTION

According to one exemplary embodiment, a magnetic component comprises one or more first litz-wire windings; and one or more first metallic cooling tube windings, wherein each first litz-wire winding is wound together with a corresponding first metallic cooling tube winding on a common bobbin to provide an indirectly-cooled magnetic component spindle assembly.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

Figure 1:
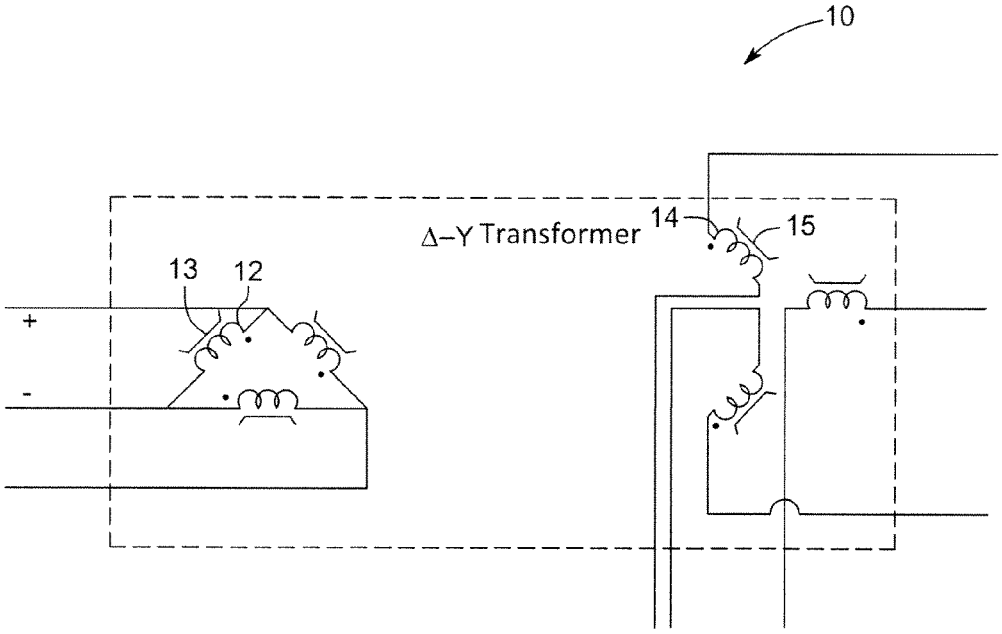
FIG. 1 illustrates a transformer winding configuration according to one embodiment.
Figure 2:
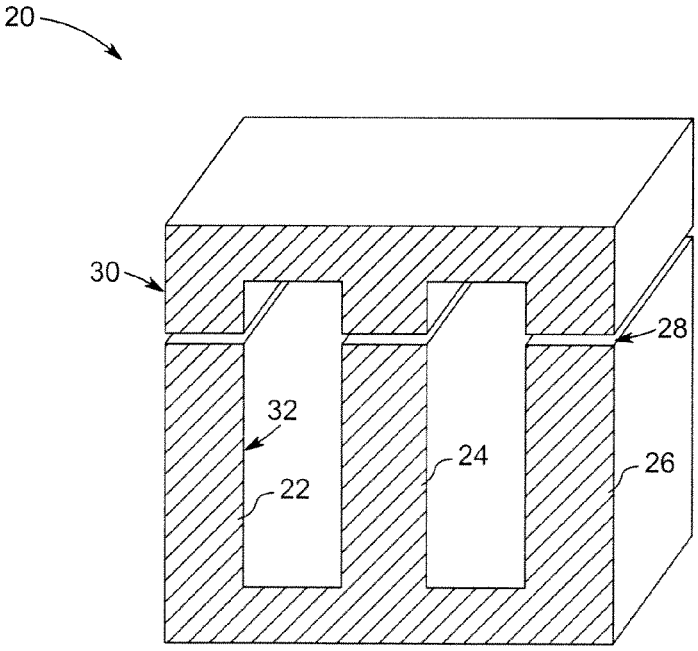
FIG. 2 illustrates a magnetic transformer core suitable to implement the configuration depicted in FIG. 1 according to one embodiment.

FIG. 1 illustrates a MW-level delta-open star transformer winding configuration 10 that is suitable for operating at a fundamental frequency of about hundreds of Hz, when constructed according to the principles described herein. According to one embodiment, transformer 10 employs de-ionized (DI) water indirect cooling described in further detail herein.

Particular embodiments of MWs-level transformer winding configuration 10 described in further detail herein are constructed with a magnetic core and litz-wire windings. Each phase in the transformer winding 10 comprises a first winding and a second winding. The windings are cooled by hollow metal cooling tubes that are wound on the same winding form as the windings. In particular embodiments, the first windings comprise a first litz-wire winding 12 and a corresponding metal cooling tube 13. The second windings comprise a second litz-wire winding 14 and a corresponding metal cooling tube 15. The metal cooling tubes and the windings are embedded in a resin or epoxy to maximize thermal conductivity between the windings and the metal tubes according to one aspect of the disclosure. The metal tubes carry a fluid such as DI water or other suitable fluid that works to extract heat away from the windings. According to one embodiment, the fluid is sustained through a closed loop thermal system that comprises a heat exchanger to accept the rejected heat from the windings.

The transformer core described in further detail herein is cooled through cold-plates that are attached to the surfaces of the magnetic core. The cold-plates sustain fluid flow that removes heat away from the core to the central heat exchanger, similar to the winding cooling loop, also described in further detail herein.

Further details of transformer winding 10 that is configured to support multi-megawatts power applications operating at high fundamental frequencies, e.g. about 100 Hz to about 1 kHz, are now described herein with reference to FIGS. 2-6. Looking now at FIG. 2, a magnetic transformer core 20 suitable to implement a multi-megawatts, high fundamental frequency transformer design is illustrated according to one embodiment. Transformer core 20 comprises three winding legs 22, 24, 26. Although a core-type transformer is described herein, the principles described herein apply equally well to 5-leg shell-type transformer structures. According to one aspect, transformer core 20 can be realized by stacking laminations of a suitable magnetic material. The laminations can be stacked by assembly, as in conventional silicon-steel cores, or through a winding process in which a ribbon of thin magnetic material is wound to achieve the illustrated geometry, as in tape-wound cores. An air gap 28 in disposed in the legs 22, 24, and 26 to control the magnetizing inductance of the magnetic core 20. The core 20, according to one aspect, comprises a top E-portion 30, and a bottom E-portion 32, that are interfaced with one another to form the three-phase transformer core 20.

Figure 3:
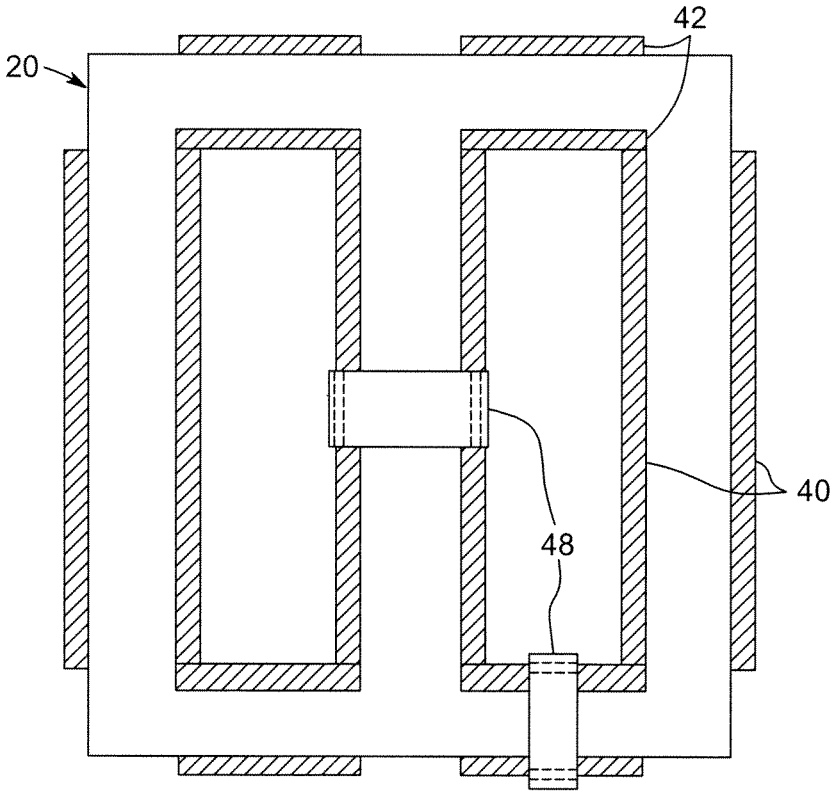
FIG. 3 illustrates placement of cooling plates for the transformer core depicted in FIG. 2 according to one embodiment.

According to one aspect, transformer core 20 is cooled through metallic cold plates 40, 42 that are attached to the surfaces of the core 20. FIG. 3 illustrates placement of vertically placed cold plates 40 and horizontally placed cold plates 42 for the transformer core 20 according to one embodiment.

Figure 4:
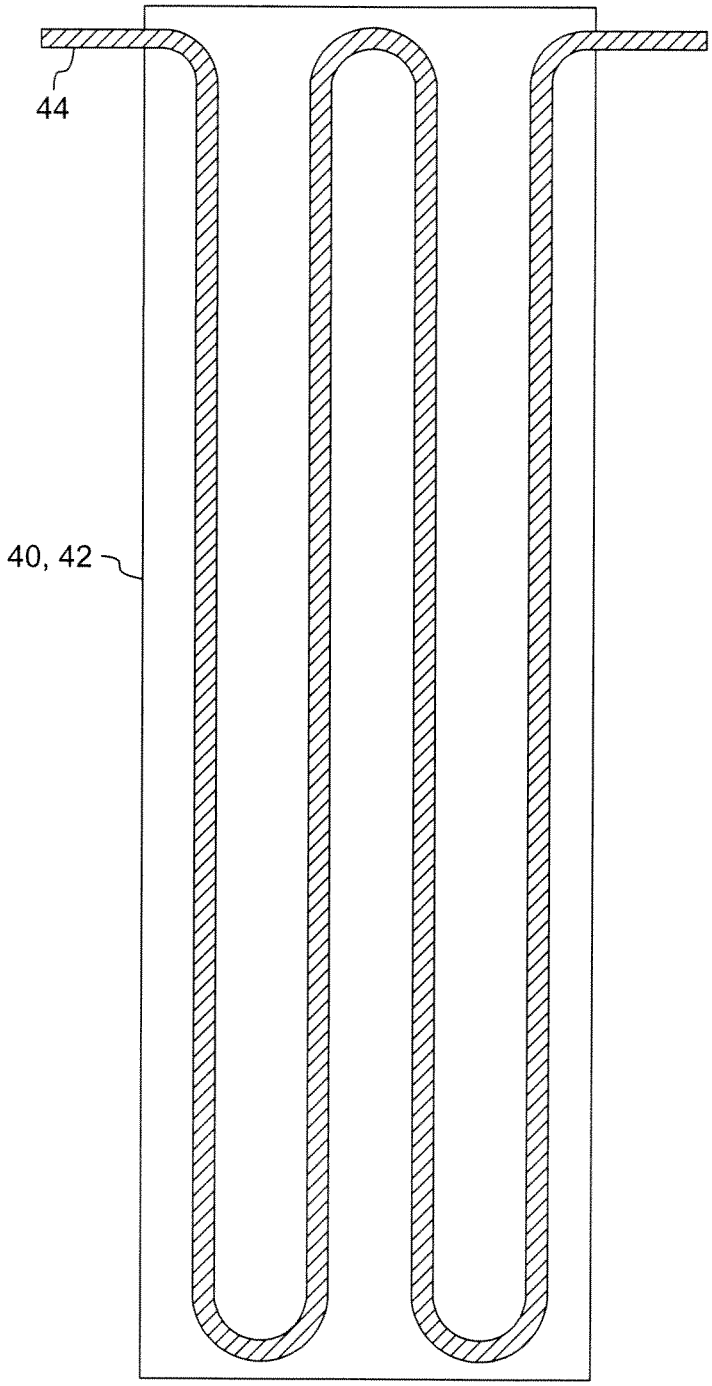
FIG. 4 illustrates in more detail, one embodiment of a cooling plate depicted in FIG. 3.

FIG. 4 illustrates in more detail, one embodiment of the cold plates 40, 42 depicted in FIG. 3. Cold plates 40, 42 comprise multiple passes of metallic tubes 44 that are embedded or at least partially embedded in the body of the cold plates 40, 42 for sustaining thermal fluid flow. The flat surfaces of the cold plates 40, 42 are attached to the vertical and horizontal sections of the transformer core 20 by bonding through a thermally conductive epoxy according to one embodiment. The heat from the core 20 flows through the core 20 and corresponding epoxy into the cold plates 40, 42 and is transferred to a central heat exchanger by the thermal fluid flowing at calculated flow rates according to one embodiment. According to one aspect, each cold plate 40, 42 is clamped in place via, for example, a conventional C-clamp-like mechanism 48, to ensure mechanical stability.

Figure 5:
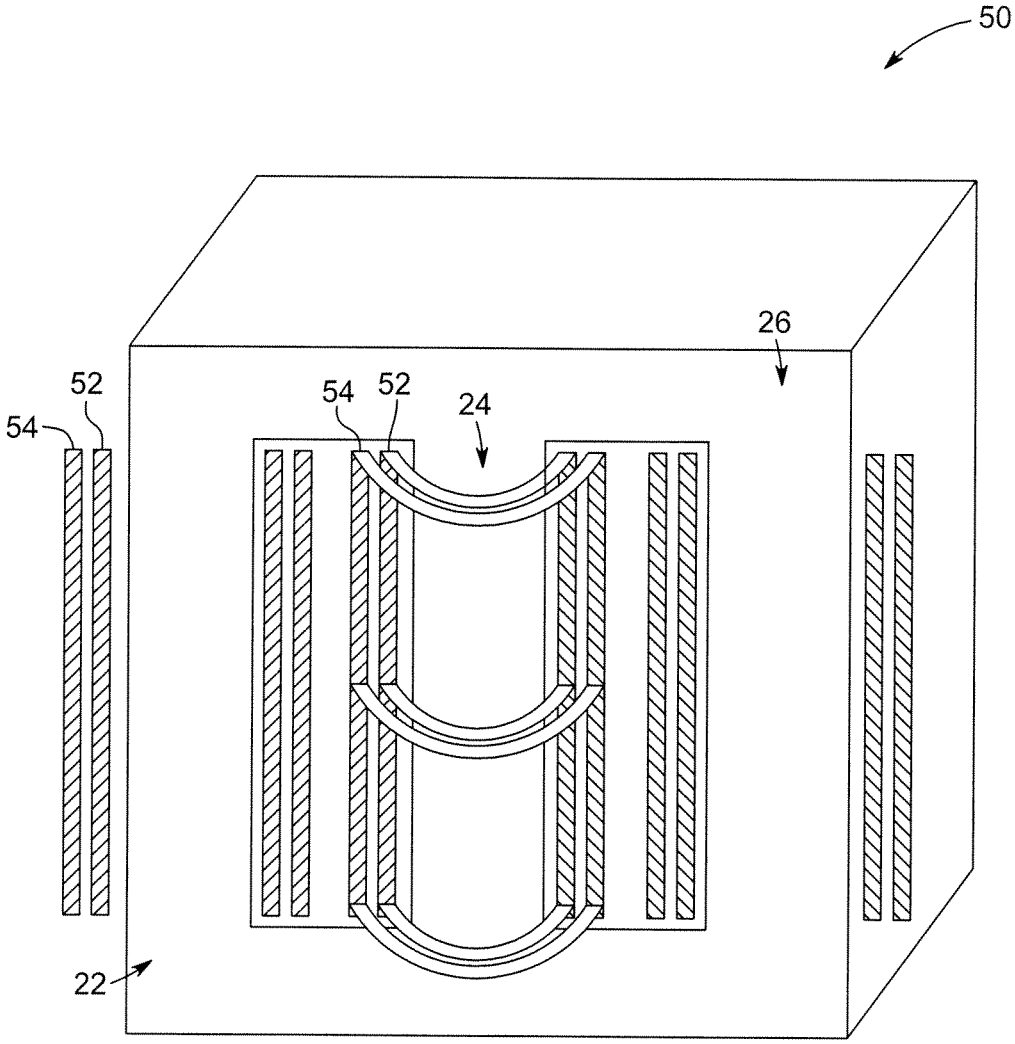
FIG. 5 illustrates a winding geometry suitable for use to implement the transformer winding configuration depicted in FIG. 1 according to one embodiment.

FIG. 5 illustrates a winding geometry 50 suitable for use to implement the multi-MWs, high fundamental frequency transformer winding configuration 10 depicted in FIG. 1 according to one embodiment. The first windings 52 and the second windings 54 are disposed around the magnetic core legs 22, 24, and 26.

Figure 6:
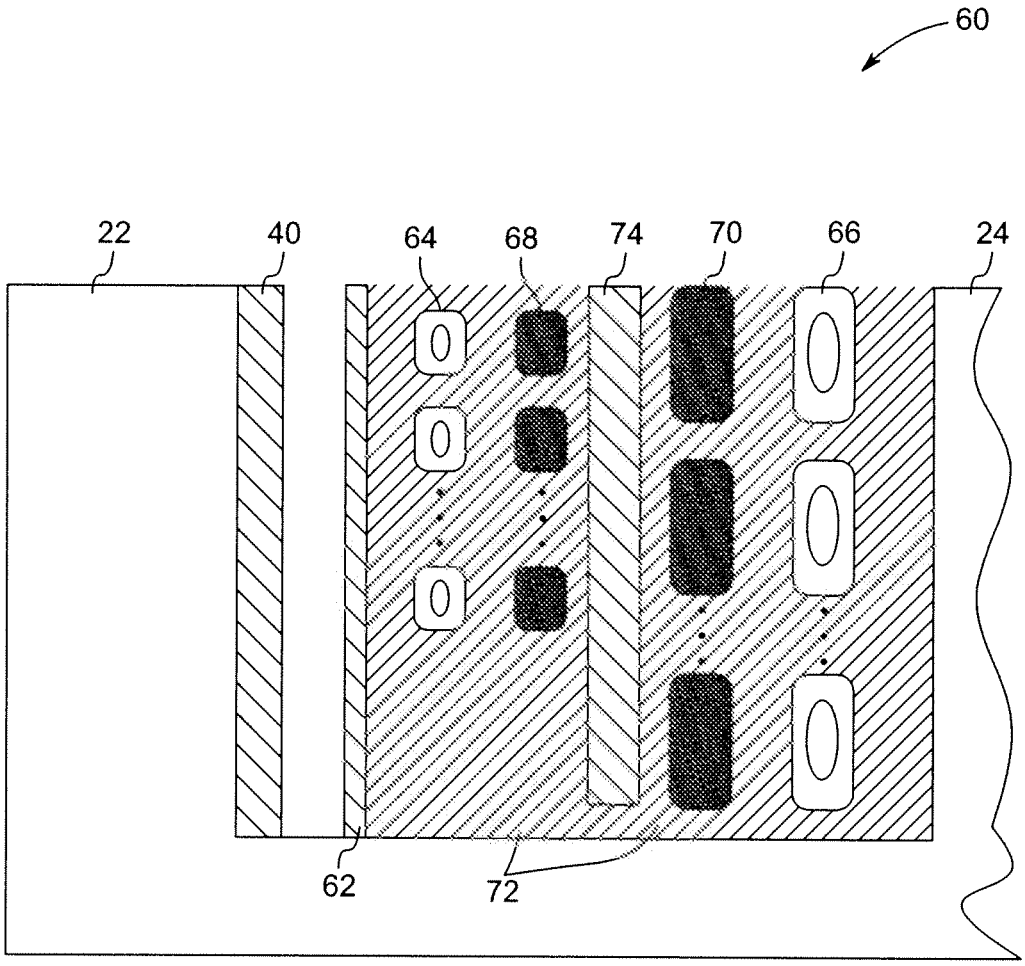
FIG. 6 illustrates one embodiment of a winding/cooling structure suitable to implement the transformer winding configuration depicted in FIG. 1.

According to one embodiment, a race-track shaped bobbin 62 shown in FIG. 6 is constructed such that it can fit around one of the magnetic core legs 22, 24, 26. A bobbin 62 is similarly constructed for each leg. Thus, a three-phase transformer will have three bobbins. Each bobbin 62 is configured to provide clearance for the corresponding cold plates 40, 42 depicted in FIG. 3 that are attached to the magnetic core 20.

FIG. 6 illustrates one embodiment of a winding/cooling structure 60 suitable to implement the multi-MWs, high fundamental frequency transformer winding configuration 10 depicted in FIG. 1. Each leg 22, 24, 26 employs a spindle assembly 60 that comprises a bobbin 62, cooling tubes 64, 66, litz-wire windings 68, 70, thermally conductive epoxy or resin 72, and electrical insulation materials 74.

With continued reference to FIG. 6, each bobbin 62 may comprise an electrical insulating material such as, for example, Nomex. A hollow cooling tube 64 comprising a metallic material such as aluminum or stainless steel is wound on the bobbin 62. According to one aspect, cooling tube 64 comprises the same number of turns as the first electrical winding 68. Cooling tube 64 is wrapped with sufficient electrical-insulation tape such as Nomex prior to winding in order to withstand the turn-turn voltage that may exist between each turn of the cooling tube 64 according to one aspect.

A layer of litz-wire is wound on top of the cooling tube 64 winding to provide a first litz-wire winding 68 for each leg. The litz-wire comprises several, e.g. hundreds or thousands, of smaller wire strands housed in a bundle. The strands are designed to exhibit a diameter that is much smaller than the skin-depth at the frequency of operation. This is done in order to reduce circulating currents in the strands due to skin-effect and proximity effect. According to one aspect, each litz-wire bundle is wrapped with electrical-insulation tape prior to winding in order to withstand the turn-to-turn voltage induced in the winding. Cooling tube 64 winding together with the litz-wire winding 68 form the first winding for the transformer 10.

A layer of insulating material 74 is wound on the first litz-wire winding 68. The thickness of the insulating material 74 is configured to provide sufficient insulation between the second winding discussed in further detail herein and the first winding.

A layer of litz-wire with a predetermined number of turns is wound on top of the insulating material 74 to provide a second litz-wire winding 70 for each leg. The construction of the second winding is similar to that of the first winding.

A hollow cooling tube 66 comprising a metallic material such as aluminum or stainless steel is wound on the second litz-wire winding 70. According to one aspect, cooling tube 66 comprises the same number of turns as the second electrical winding 70. Cooling tube 66 is wrapped with sufficient electrical-insulation tape such as Nomex prior to winding in order to withstand the turn-turn voltage that may exist between each turn of the cooling tube 66 according to one embodiment.

According to one embodiment, each spindle assembly is comprised of bobbin 62, cooling tubes 64, 66, first litz-wire winding 68, second litz-wire winding 70 and second winding-first winding insulation layer 74 is embedded in an insulating medium such as resin or epoxy prior to its installation one of the magnetic core legs 22, 24, 26. The embedding process according to particular embodiments comprises a standard epoxy-case process or a vacuum pressure impregnation process, wherein the bobbin assembly is immersed in the resin or epoxy and heat treated for curing.

The cross-sectional area of the litz-wire bundles 68, 70 for second and first windings, the dimensions of the hollow cooling tubes 64, 66 and the choice of epoxy or resin are interrelated in that they are co-optimized for maximizing the thermal conductivity of the processed spindle assembly in order to effectively remove heat. The litz-wire bundles 68, 70 may be rectangular, square, circular, or elliptical according to particular embodiments. The cooling tubes 64, 66 may also be rectangular or circular in cross-section according to particular embodiments. According to one aspect, the cooling tubes 64, 66 serve an additional purpose of providing a means to sense the voltage. The metallic tube 64 abutting the first litz-wire winding 68 essentially comprises a tertiary winding that sustains the same voltage as the first litz-wire winding 68. This voltage can be integrated, for example, to yield an estimate of the flux in the magnetic core 20. Cooling circuits 64 and 66 are each connected with the external cooling system, comprising the heat exchanger, through electrically insulating connections such as rubber tubes according to one aspect.

According to particular embodiments, the second windings and the first windings can be configured in a star or a delta fashion. According to one embodiment, the second windings are configured as an open star connection and the first windings are configured as a delta connection, such as depicted in FIG. 1.

The embodiments described herein advantageously provide without limitation, a high power, multi-megawatts level, high fundamental frequency, e.g. up to about 1 kHz, dry-type transformer with indirect cooling for windings and the magnetic core to yield a high efficiency and high power density transformer. Advantages provided using the principles described herein comprise 1) advanced cooling in the windings and the magnetic core, 2) a lightweight structure through use of a smaller magnetic core, 3) high power density, e.g. about 2.5 kVA per kg, relative to about 1 kVA per kg of oil cooled solutions for the same applications, and 4) competitive efficiency between about 98% and about 99% due to its smaller size.

The embodiments described herein further provide commercial advantages that comprise without limitation, 1) a lightweight power conversion system that is devoid of copper in the coolant path and thus avoids contaminating shared cooling DI water that may run through heat sinks constructed from aluminum, 2) ease of shipping a lightweight transformer, and 3) weighs only about 2500 kg as compared to about 5000 kg for competitive designs.

This written description uses examples of the subject matter disclosed to enable any person skilled in the art to practice the same, comprising making and using any devices or systems and performing any incorporated methods. The patentable scope of the subject matter is defined by the claims, and may comprise other examples that occur to those skilled in the art. Such other examples are intended to be within the scope of the claims.

What is claimed is:

1. A magnetic component comprising:

a first layer of litz-wire windings; and one or more first cooling tube windings which are metallic and hollow, and configured to extract heat from the corresponding first layer of litz-wire windings, wherein the first layer of litz-wire windings is wound together with a corresponding first cooling tube winding on a common bobbin, and wherein the first layer of litz-wire winding is configured to be spaced apart from the corresponding first cooling tube winding to provide an indirectly-cooled magnetic component spindle assembly, and wherein the first layer of litz-wire windings are disposed outside of the corresponding first cooling tube windings relative to the common bobbin;

a second layer of litz-wire windings, wherein the second layer of litz-wire windings wound together with a second cooling tube winding, the second cooling tube windings being hollow and metallic; and an insulating layer disposed between the first layer of litz-wire windings and the second layer of litz-wire windings to electrically insulate the first and second layers of litz-wire windings from one another;

wherein the first layer of litz-wire windings and its corresponding first cooling tube winding comprise an identical number of winding turns;

wherein the second layer of litz-wire windings and its corresponding second cooling tube winding comprise an identical number of winding turns.

2. The magnetic component according to claim 1, wherein each spindle assembly is embedded in resin or epoxy, and wherein the resin or epoxy fills the space between the first layer of litz-wire windings and the corresponding one or more metallic cooling tube windings.

3. The magnetic component according to claim 1, further comprising a thermal coolant disposed within each cooling tube.

4. The magnetic component according to claim 1, further comprising:

a magnetic core; and wherein each second layer of litz-wire windings is configured to be spaced apart from corresponding second metallic cooling tube winding.

5. The magnetic component according to claim 4, further comprising a plurality of cold plates attached to predetermined surfaces of the magnetic core.

6. The magnetic component according to claim 5, wherein each cold plate comprises at least one cooling tube disposed therein and configured to transfer heat away from the magnetic core via a thermal fluid passing through the at least one cooling tube.

7. The magnetic component according to claim 5, wherein each cold plate is bonded to a surface of the magnetic core via a thermally conductive epoxy.

8. The magnetic component according to claim 4, wherein the magnetic core comprises a plurality of legs, wherein each leg comprises an air gap configured to control a magnetizing inductance.

9. The magnetic component according to claim 1, wherein each cooling tube is wrapped in electrical insulation material.

10. The magnetic component according to claim 1, wherein each litz-wire is wrapped in electrical insulation tape sufficient to withstand a corresponding turn-to-turn induced voltage.

11. The magnetic component according to claim 1, wherein the magnetic component comprises an inductor.

12. The magnetic component according to claim 1, wherein the magnetic component comprises a transformer.

13. The magnetic component according to claim 1, wherein the bobbin comprises an electrical insulation material selected from Nomex.

14. A magnetic component comprising:

a first layer of litz wire windings;

one or more first metallic cooling tube windings which are metallic and hollow configured to extract heat from a corresponding first layer of litz-wire windings; wherein the first layer of litz-wire windings is wound together with a corresponding first metallic cooling tube winding on a common bobbin, wherein the first layer of litz-wire winding is configured to be spaced apart from the corresponding metallic cooling tube windings so as to provide an indirectly-cooled magnetic component spindle assembly;

a second layer of litz-wire windings, second layer of litz-wire windings wound together with one or more second cooling tube winding, the second cooling tube windings being hollow and metallic; and an insulating layer disposed between the first layer of litz-wire windings and the second layer of litz-wire windings to electrically insulate the first and second layers of litz-wire windings from one another;

wherein the first layer of litz-wire windings and its corresponding first cooling tube winding comprise an identical number of winding turns;

wherein the second layer of litz-wire windings and its corresponding second cooling tube winding comprise an identical number of winding turns.

15. A transformer, comprising:

a first layer of litz-wire windings; and a layer of one or more first cooling tube windings which are metallic and hollow, configured to extract heat from the corresponding first layer of litz-wire windings and wound together with the first layer of litz-wire windings on a common bobbin, wherein the first layer of litz-wire winding is configured to be spaced apart from the corresponding metallic cooling tube windings so as to provide an indirectly-cooled magnetic component spindle assembly;

a second layer of litz-wire windings, the second layer of litz-wire windings wound together with one or more second cooling tube winding, the second cooling tube windings being hollow and metallic; and an insulating layer disposed between the first layer of litz-wire winding and the second layer of litz-wire windings to electrically insulate the first and second layers of litz-wire windings from one another;

wherein the first layer of litz-wire windings and its corresponding first cooling tube winding comprise an identical number of winding turns;

wherein the second layer of litz-wire windings and its corresponding second cooling tube winding comprise an identical number of winding turns.

16. The transformer according to claim 15, further comprising a layer of thermally conductive material configured to be filled in a space between the first layer of litz-wire windings and the layer of one or more first cooling tube windings.

17. The transformer according to claim 15, further comprising:

a magnetic core;

wherein the second layer of litz-wire windings is spaced apart from the layer of one or more second cooling tube windings to provide another indirectly-cooled transformer spindle assembly; and wherein the second layer litz-wire windings are disposed outside of the layer of one or more second cooling tube windings relative to the another common bobbin.

* * * * *